US005875371A

United States Patent [19]

Knecht et al.

[11] Patent Number: 5,875,371

[45] Date of Patent: Feb. 23, 1999

[54] METHOD AND APPARATUS FOR DEVELOPING SHEET OR STRIP TYPE PHOTOGRAPHIC MATERIAL

[76] Inventors: Hugo Knecht, Surbgasse 36, 8165 Schöfflisdorf; Rudolf Wacker, Rainstrasse 16A, 5022 Rombach; Rudolf Dech, Unterdorfstrasse 2, 8165 Schöfflisdorf, all of Switzerland; Gabriele Poli, Via Schiavolin 4, 33080 Roveredo in Piano; Eni Scodellaro, Via Baseglia, 8, 33097 Gaio di Spilimbergo, both of Italy; Anthony Earle, 11, Brookshill Avenue, Harrow Middlesex HA3 6RZ, Great Britain

[21] Appl. No.: 803,251

[22] Filed: Feb. 20, 1997

[30] Foreign Application Priority Data

Feb. 20, 1996 [EP] European Pat. Off. ..... 96810100

[51] Int. Cl.[6] ..... G03D 13/00; G03D 3/08

[52] U.S. Cl. ..... 396/612; 396/636; 396/641; 396/626

[58] Field of Search ..... 396/612, 614, 396/620, 622, 625, 626, 636, 641, 630

[56] References Cited

U.S. PATENT DOCUMENTS

| | | | |
|---|---|---|---|
| 5,179,404 | 1/1993 | Bartell et al. | 396/641 |
| 5,270,762 | 12/1993 | Rosenburgh et al. | 396/626 |
| 5,309,191 | 5/1994 | Bartell et al. | 396/626 |
| 5,311,235 | 5/1994 | Piccinino, Jr. et al. | 396/618 |

FOREIGN PATENT DOCUMENTS

| | | |
|---|---|---|
| 0 222 583A2 | 5/1987 | European Pat. Off. . |
| 0 559 027A1 | 9/1993 | European Pat. Off. . |
| 0 559 028A1 | 9/1993 | European Pat. Off. . |
| 32 42 810A1 | 5/1984 | Germany . |
| 85/02919 | 7/1985 | WIPO . |

*Primary Examiner*—D. Rutledge

*Attorney, Agent, or Firm*—Burns, Doane, Swecker & Mathis, LLP

[57] ABSTRACT

Exemplary embodiments of the present invention include two half shells that can be operably joined together, in whose walls pouches are provided. Two elements, approximately formed as ladders, each include first transport rollers, the two ladderlike elements being configured for insertion in the joined together half-shells. The first transport rollers are disposed on the respective ladderlike elements in such a way that upon insertion of the ladderlike elements into the joined together half-shells, the transport rollers fit into the pouches of the walls of the respective half shells. Exemplary embodiments also include a central element which, after the insertion of the two ladderlike elements, can be placed between the two ladderlike elements to maintain the two ladderlike elements in position and which, together with the respective ladderlike elements and the respective walls of the half-shells, defines a conduit for photographic material to be developed. This conduit extends between each of the ladderlike elements and the central element, and between the walls of each of the half-shells and the central element. Second transport rollers are provided on the central element which, after the insertion of the central element, contact the first transport rollers of the ladderlike elements, so that the photographic material to be developed is guided between the first transport rollers and the second transport rollers and transported through the conduit.

20 Claims, 12 Drawing Sheets

METHOD AND APPARATUS FOR DEVELOPING SHEET OR STRIP TYPE PHOTOGRAPHIC MATERIAL

BACKGROUND OF THE INVENTION

1. Field of the Invention

The invention relates to an apparatus for developing sheet- or strip-type photographic material.

2. State of the Art

Apparatuses for developing sheet- or strip-type photographic material are widely known in the photo finishing field, being known as film processors in the case of films to be developed and paper processors in the case of exposed paper. Especially in the case of paper processors, it can happen that the paper exposed in the printer and to be developed in the paper processor is either in single-sheet form or in the form of long strips of paper, which are not cut apart into individual paper pictures until after development. The single sheets or paper strips are transported for developing through one or more wet chemical baths, and the development of the pictures takes place by the action of the developer fluid.

The volume of such wet-chemical baths in the processors—for the sake of simplicity, only paper processors will be discussed hereinafter—depends substantially on what throughput (number of developed pictures per unit of time) the particular user, as a rule developing labs, seeks to attain. For a relatively high throughput, the distance through the paper processor must be correspondingly long, so that there can be as many pictures as possible in the paper processor simultaneously, and with continuous transport on the one hand and a relatively fast transport speed on the other, the transit time of the paper through the paper processor matches the length of time necessary for the development (which of course is known beforehand). The consequence is baths of relatively large volume.

For the user of so-called minilabs or microlabs (both will hereinafter be referred to as minilabs). conversely, a substantially lower throughput is of interest. Accordingly, the transport speed through the wet-chemical baths can also be reduced. Only considerably smaller volumes are therefore required for the baths of such minilabs. However, for the baths of such minilabs it is also necessary that the developer fluid always be "fresh", so that the developed paper pictures will all meet a uniform standard of quality. As a consequence, the small-volume baths especially must be replaced or replenished from time to time. Moreover, lively motion of the wet-chemical baths in the paper processor has proven to be advantageous, since in this way fresh developer fluid is brought again and again into contact with the paper to be developed. It will be appreciated that complete replacement or replenishment of the baths occurs at shorter time intervals in smaller-volume baths than in larger-volume baths. Paper processors with small-volume baths have therefore already been proposed, for example, in U.S. Pat. Nos.: 5,179,404; 5,309,191; 5,311,235; and 5,270,762.

After a certain length of time, however, the developer fluid in the paper processor becomes unusable (the developer fluid oxidizes), even if it has been virtually unused (for instance, if no developing jobs have been performed); it must then be completely replaced. The developer fluid must be replenished or regenerated so that it remains stable and does not become unusable. To this end, based on a per unit area of developed paper, a predetermined amount of regenerated or of fresh developer fluid must be added to the bath. The smaller the entire volume of developer fluid in the paper processor, the faster is practically all the volume of developer fluid located in the paper processor regenerated or replaced, even if the throughput is low. Paper processors which, in proportion to the throughput, furnish a small volume of developer fluid have therefore greater long-term stability.

Paper processors with high long-term stability are especially advantageous for the minilabs and microlabs already mentioned, in which the average throughput is relatively slight, yet which nevertheless needs high performance equipment to handle peak loads (as in one-hour photo developing). In such a minilab or microlab, the distance through the paper processor must therefore on the one hand be long enough to enable handling of the peak loads, while on the other hand, the entire volume of developer fluid must be as small as possible, so that high long-term stability is assured even at a low average throughput. The situation is similar on the professional level, where large paper sizes (poster size) require a large paper processor whose average throughput is nevertheless low.

Aside from the replacement or replenishment of the developer fluid, in paper processors the transport rollers (and as needed other elements of the paper processor) must also be cleaned from time to time, so that soiling of elements of the paper processor will not cause losses of quality in the developed paper pictures. This necessitates a complete interruption of the wet chemical developing processor. For cleaning, the rollers must either be removed from the paper processor, or they must be cleaned while remaining inside the paper processor—but as a rule, they are taken out for cleaning. For the most efficient possible use of the paper processor (and naturally this also applies to film processors), it is therefore desirable, and an object of the invention, that this cleaning be performed as simply and as fast as possible. In addition, the processor should be simple to manufacture and should be reliable in function.

SUMMARY OF THE INVENTION

According to exemplary embodiments of the invention, an apparatus is provided which includes two half-shells that can be operably joined together, the two half-shells having wall pouches. Moreover, the apparatus has two elements approximately in the form of a ladder, on each of which first transport rollers are provided. These first transport rollers are disposed on each respective ladderlike element in such a way that on insertion of the ladderlike elements into the joined-together half-shells, they fit into the wall pouches of the respective half-shells. The apparatus also includes a central element which, after the insertion of the two ladderlike elements, is operably configured for placement between the two ladderlike elements. After insertion of the central element, this central element—referred to herein as a "rack"—keeps the two ladderlike elements in position and together with each respective ladderlike element and with the wall of each respective half-shell, defines a conduit for the photographic material to be developed. This conduit extends between the respective ladderlike elements and the central element, and between the wall of each respective half-shell and the central element, and has a turnaround point at its lower end. Second transport rollers are provided on the central element, which are in contact with the first transport rollers of the ladderlike elements, so that the photographic material to be developed is guided between the first transport rollers and the second transport rollers and transported through the conduit. Such an apparatus (processor) can be taken apart and put back together again simply and easily, and is reliable in its function. Moreover, such an apparatus is easy to manufacture.

Especially advantageous further features or improvements pertain, in particular, to the ease of manufacture of the two half-shells using plastics technology, such as injection molding (technically well-mastered, economical manufacture), the transport mechanism (only one drive means needed), and the action of developer fluid upon the photographic material (good quality of the developed material)—in one case from the side of the two half-shells, and in another case from the side of the central element—depending on whether the coating side in the conduit is toward the half-shells or toward the central element ("coating side in or out"). The slit through which the action upon the photographic material takes place can be disposed in inclined fashion so that, in particular, the front edge of the material to be developed cannot slip into the slit. Backups can thus be avoided. A further feature pertains to the central element, on which a connection piece (e.g., pipe connector) is provided, which upon introduction of the central element into the half-shells automatically engages a corresponding counterpart, so that the delivery of fresh or replenished developer fluid is automatically assured in a single operation (i.e., upon insertion of the central element).

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
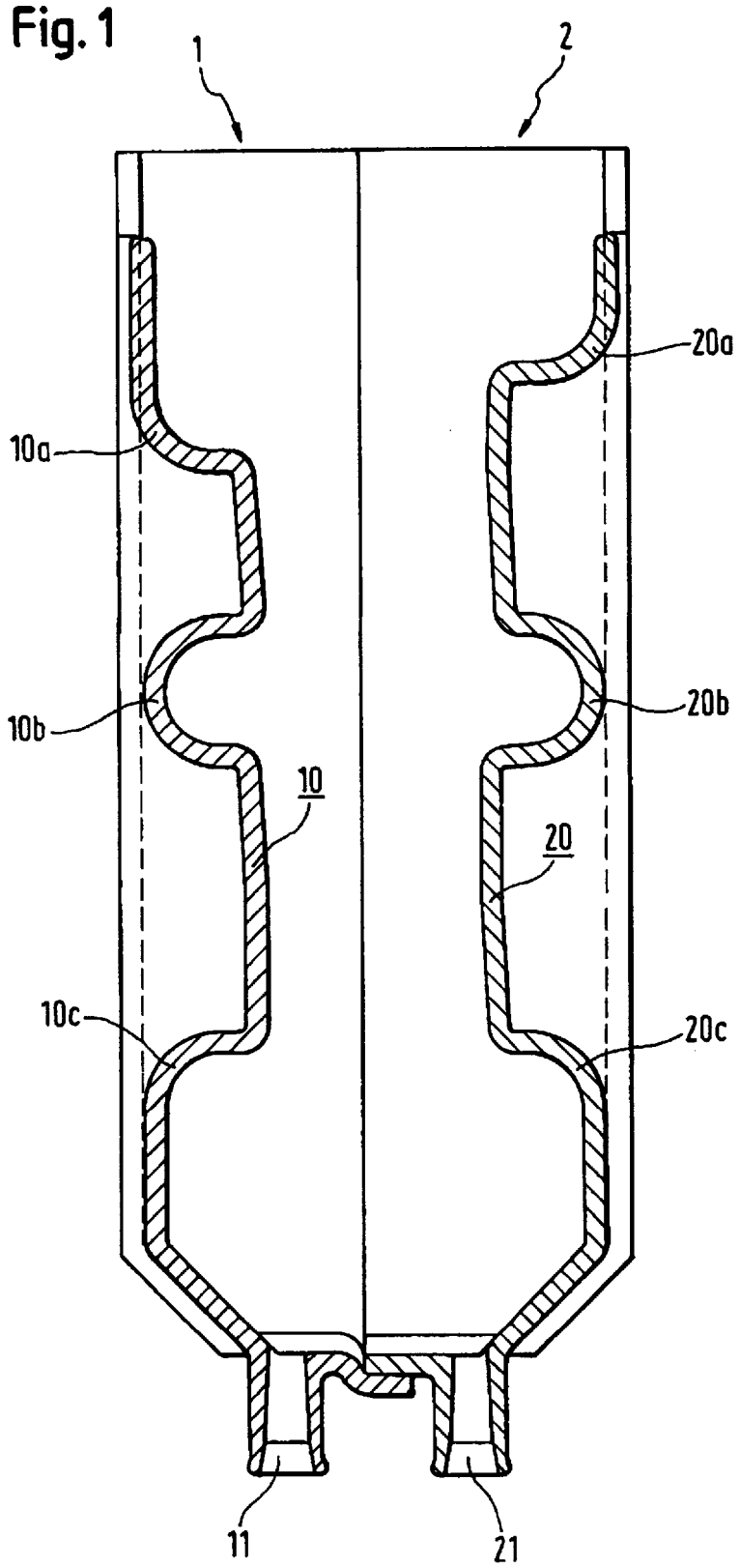
FIG. 1 is an exemplary embodiment of two still-empty but joined-together half-shells of an exemplary apparatus according to the invention.

In FIG. 1, two empty half-shells of an exemplary embodiment of an apparatus according to the invention can be seen to include a left half-shell 1 and a right half-shell 2 (in the ensuing description, left and right here are meant solely in terms of the applicable drawing figure). The left half-shell has a wall 10, in which a plurality of pouches 10*a*, 10*b* and 10*c* are provided. Pouches 20*a*, 20*b*, 20*c* are also provided in the wall 20 of the right half-shell. On the lower end of each of the respective half-shells 1 and 2 are respective outlets 11 and 21 for developer fluid. The two half-shells are operably joined together in a fluid-tight manner and can, for example, be glued together or welded by ultrasound; what is important is that they be joined together in a fluid-tight manner.

Figure 2:
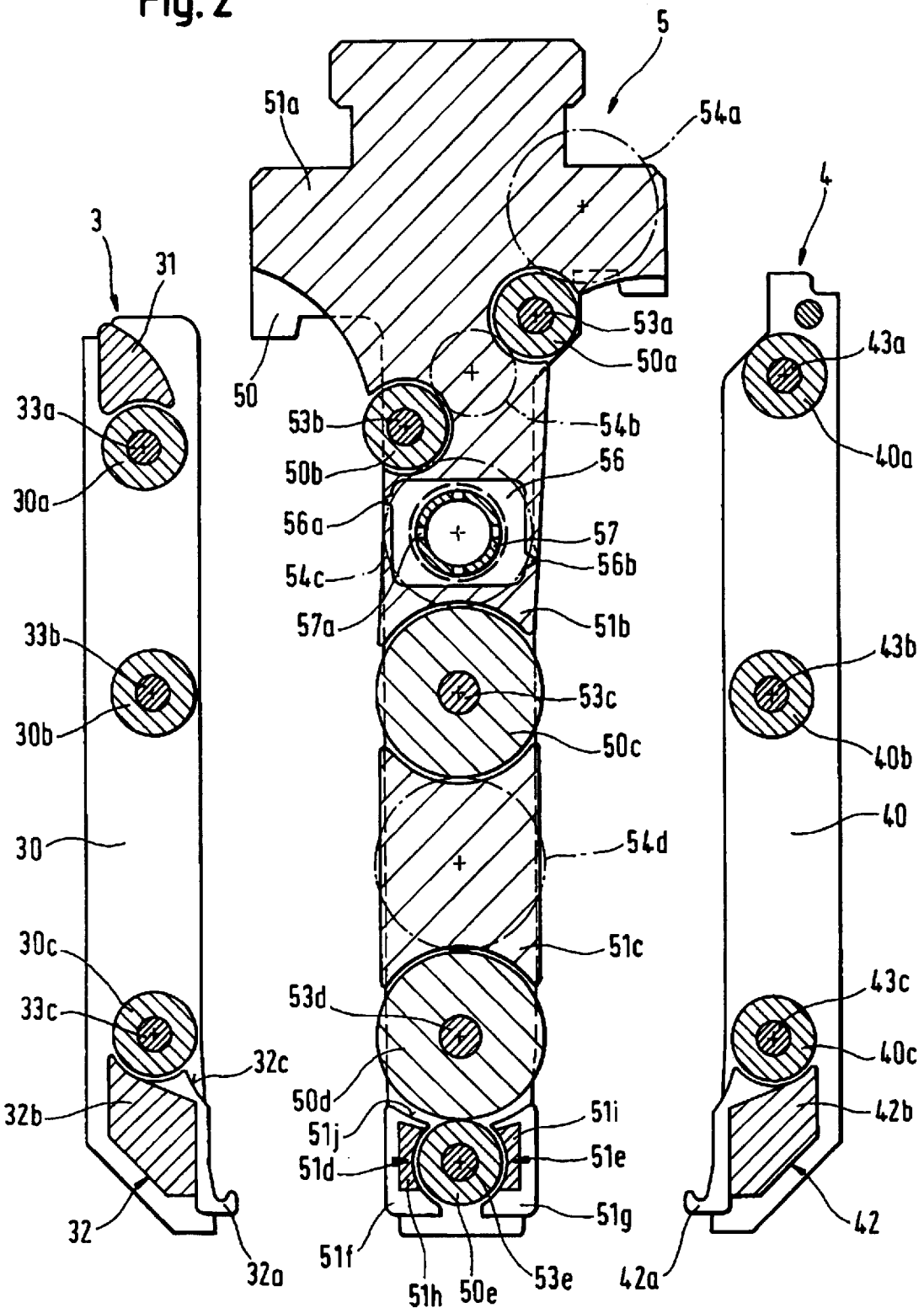
FIG. 2 is an exemplary embodiment of a side bar of two ladderlike elements with the associated first transport rollers, and an exemplary embodiment of a central element with associated second transport rollers.

FIG. 2 shows the various elements that are introduced into the two half-shells of an exemplary apparatus according to the invention. These elements include, on the one hand, the two ladderlike elements represented in FIG. 2 as a left ladderlike element 3 and a right ladderlike element 4, and a central element 5 or "rack". Of the two ladderlike elements 3 and 4, all that can be seen are respective side bars 30 and 40 and associated first transport rollers 30*a*, 30*b*, 30*c* and 40*a*, 40*b*, 40*c*, respectively. The first transport rollers can be embodied elastically and/or resiliently supported, in principle in a manner similar to what is shown and described in, for example, U.S. Pat. No. 5,270,762, the disclosure of which is hereby incorporated by reference in its entirety.

Naturally the ladderlike elements also have a corresponding second side bar, but it is not shown (it can be thought of as being located above the plane of the drawing). The first transport rollers are each extended by shafts 33*a*, 33*b*, 33*c* and 43*a*, 43*b*, 43*c*. By rotation of these shafts, the first transport rollers are also rotatable together with the shafts. One gear wheel is disposed on each of the extensions of the shafts 33*a*, 33*b*, 33*c* and 43*a*, 43*b*, 43*c*. Although the gear wheels are not visible in FIG. 2, they are disposed behind the rollers as it were, or in other words, behind the plane of the drawing but still in front of the corresponding side bars 30 and 40 (in a manner similar to that illustrated with respect to gear wheels of the central element 5 in FIG. 9). That is, the gear wheels are disposed between each respective first transport roller and a respective side bar 30 or 40. A guide piece 31 for the photographic material is also provided at the top of the left ladderlike element 3. Further guide pieces, identified overall by reference numerals 32 and 42, respectively, are also disposed on the lower end of each of the two side bars 30 and 40, and they have a plurality of hooklike prongs 32*a* and 42*a*, respectively, and connecting pieces 32*b* and 42*b* disposed between the hooklike prongs, so that the hooklike prongs 32*a* and 42*a* and the connecting pieces 32*b* and 42*b* alternately succeed one another. This can be seen still better in FIG. 3.

The central element 5 of FIG. 2, or rack, has two side flanges, of which only one side flange 50 is shown (the other is located, as it were, above the plane of the drawing).

A plurality of individual parts are disposed between the side flanges and are joined to the side flanges. These individual parts involve guide pieces 51*a*, 51*b*, 51*c*, which serve on the one hand to guide the photographic material and on the other hand act as intermediate pieces, also provided on the rack, between the second transport rollers. The guide piece 51*a* is embodied on its upper end as a handle, with whose aid the rack is introduced into the joined-together half-shells 1 and 2, once the two ladderlike elements 3 and 4 have been inserted. Naturally, the rack can also be pulled out again with the aid of the handle. The guide pieces serve not only to guide the photographic material but also to fill up volume, so that the total volume of developer fluid in the apparatus can be kept low. The guide pieces 51*a*, 51*b*, 51*c* are secured to the side flanges 50. This is similar in principle to what is described in U.S. Pat. No. 5,311,235 (see, for example, FIG. 9 thereof), the disclosure of which is hereby incorporated by reference in its entirety.

The second transport rollers 50*a*, 50*b*, 50*c*, 50*d*, 50*e* are—like the first transport rollers—extended by shafts 53*a*,

53*b,* 53*c,* 53*d,* 53*e.* By rotation of the associated shaft, the second transport rollers are rotatable together with the associated shaft. On each of the extensions of the shafts 53*a,* 53*b,* 53*c,* 53*d,* 53*e,* (shaft) gear wheels are provided, which cannot be seen in FIG. 2. They are disposed in FIG. 2 behind the second transport rollers, or in other words behind the plane of the drawing, but still in front of the side flange 50. Still other gear wheels are shown in dashed lines in FIG. 2 and identified by reference numerals 54*a,* 54*b,* 54*c,* 54*d* ("intermediate gear wheels"). These (intermediate) gear wheels 54*a,* 54*b,* 54*c,* 54*d* are disposed between the (shaft) gear wheels, which are disposed on the respective extension of the shafts 53*a,* 53*b,* 53*c,* 53*d,* 53*e.* The (intermediate) gear wheels can be embodied on a trunnion (not shown) which is provided on the side flange 50. In any case, the guide pieces 51*a,* 51*b,* 51*c* are mounted on the side flange spaced apart, so that both the gear wheels on the extensions of the shafts 53*a,* 53*b,* 53*c,* 53*d,* 53*e* and the (intermediate) gear wheels 54*a,* 54*b,* 54*c,* 54*d* disposed between them are rotatable in unhindered fashion.

The (intermediate) gear wheel 54*a* meshes with the (shaft) gear wheel on the extension of the shaft 53*a;* the (shaft) gear wheel of shaft 53*a* in turn meshes with the gear wheel 54*b.* The (intermediate) gear wheel 54*b* in turn meshes with the (shaft) gear wheel on the extension of the shaft 53*b,* and so forth. This can be done in principle approximately in the manner described in the previously mentioned U.S. Pat. No. 5,311,235 and shown in FIG. 9 thereof (except that there, the gear wheels mesh with one another as it were outside the side flange—or at least outside the inner side flange). Accordingly, an exemplary embodiment of an apparatus according to the invention includes transport rollers disposed on the central part or rack, that is, the second transport rollers 50*a,* 50*b,* 50*c,* 50*d,* 50*e,* which are all driven solely by driving of the gear wheel 54*a* (via the engagement of the gear wheels with one another).

Figure 4:
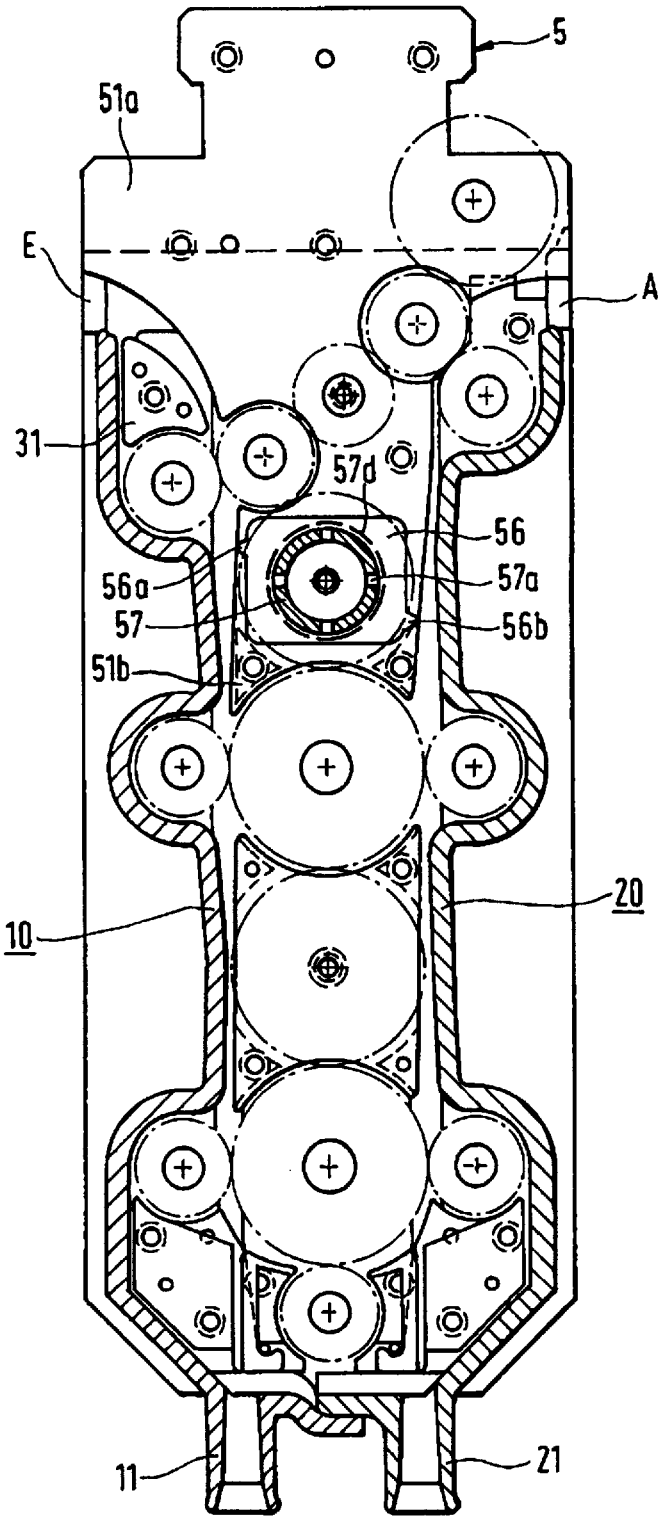
FIG. 4 shows the elements of FIG. 2 having already been introduced into the half-shells of FIG. 1.

However, the gear wheel on the extension of the shaft 53*b* meshes not only with the gear wheel 54*c* but also with the gear wheel on the extension of the shaft 33*a.* In the same way, the gear wheel on the extension of the shaft 53*a* also meshes with the gear wheel on the extension of the shaft 43*a.* This is illustrated in FIG. 4. The gear wheel on the extension of the shaft 53*c* also meshes with both the gear wheels on the extension of the shaft 33*b* and the gear wheel on the extension of the shaft 43*b.* The gear wheel on the shaft extension 53*d,* meshes with the gear wheel on the shaft extension 33*c* and also with the gear wheel on the shaft extension 53*e* as well as with the gear wheel on the shaft extension 43*c.* In this way, all of the first transport rollers, that is, the transport rollers 30*a,* 30*b,* 30*c,* and 40*a,* 40*b,* 40*c,* are driven solely by the driving of the gear wheel 54*a.*

In principle, the system would also function even if only the transport rollers of the central part 5 were driven (second transport rollers). However, the drive is further ensured when the additional drive of the transport rollers 30*a,* 30*b,* 30*c* and 40*a,* 40*b,* 40*c* of the two ladderlike elements 3 and 4, respectively is provided.

The guide pieces 32 and 42, shown on the lower end of FIG. 2, of the two ladderlike elements 3 and 4 have already been mentioned above. Each of the guide pieces 32 and 42, respectively, has alternating hooklike prongs 32*a* and 42*a* and connecting pieces 32*b* and 42*b* between these hooklike prongs. The central element 5, or rack, has two guide pieces on its lower end, which are identified overall as 51*d* and 51*e.* These guide pieces 51*d* and 51*e* likewise have alternating guides 51*f* and 51*g* and connecting pieces 51*h* and 51*i* between these guides 51*f* and 51*g.* The guides 51*f* and 51*g* are disposed such that when the central element 5 (rack) is inserted, the guides 51*f* and 51*g* of the guide pieces 51*d* and 51*e* slide into the interstices between the respective hooklike prongs 32*a* and 42*a,* respectively.

Figure 3:
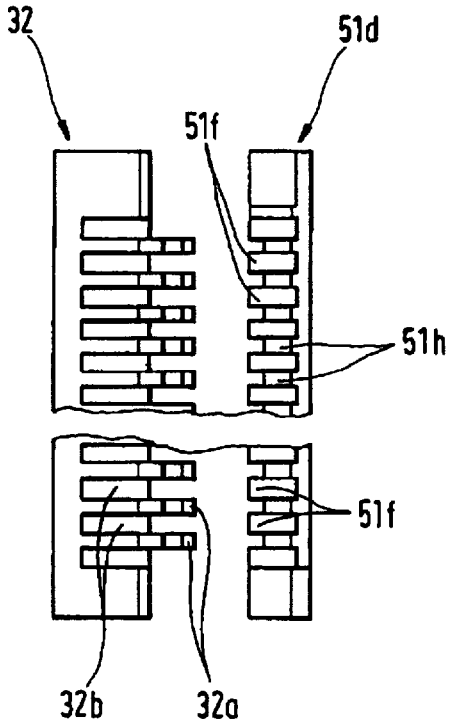
FIG. 3 is a detail of FIG. 2 which illustrates a relative location of guide pieces.

This can be seen in principle from FIG. 3, which shows a detail that corresponds to an exemplary plan view on the guide piece 32 and the associated guide piece 51*d* and which illustrates their spatial arrangement relative to one another. However, here the guides 51*f* have not slid into the interstices between the hooklike prongs 32*a,* because the two parts are shown spatially separated from one another. In practice, the guides 51*f,* on insertion of the central element 5, slide into the interstices between the hooklike prongs 32*a,* so that the paper is securely guided at all times, initially on the curved surface 32*c* of the guide piece 32 and then on the curved surface 51*j* of the guide 51*f* (FIG. 2).

In FIG. 4, the arrangement of the various elements in the two half-shells 1 and 2 can be seen. Although FIG. 4 is a sectional view, shading has essentially been dispensed with. Moreover, some things are apparent to those skilled in the art even though actually they would not look like that. It should also be noted in terms of this view, since this has not been addressed in the description of FIG. 2, that a chamber 56 which here is essentially rectangular, is formed by the guide pieces 51*a* and 51*b;* toward the conduit, this chamber has through openings 56*a* and 56*b,* which can be embodied as slits and which extend over the width of the conduit (that is, in a direction which extends into and out of the plane of the drawing). The guide pieces 51*a* and 51*b* can also be combined into a single guide piece. A tube 57 through which fresh or replenished developer fluid is supplied is guided through the chamber 56. In its wall, the tube 57 has openings 57*a,* through which the fresh or replenished developer fluid first enters the chamber 56 and then, through the slit-like openings 56*a* and 56*b,* acts on the photographic material. The tube 57 itself can be embodied as a filter, which traps dirt in the developer fluid supplied, or a separate hollow-cylindrical filter 57*d* around the tube, but not in contact with the tube 57, can be provided (as shown by dashed lines).

It is clear that this exemplary embodiment is especially suitable if the emulsion side of the photographic material to be developed points in the conduit toward the central element 5 or rack ("emulsion side in"). If the emulsion side of the photographic material in the conduit conversely points toward the ladderlike elements 3 and 4 or the walls 10 or 20, then through openings for fresh or replenished developer fluid can be expediently provided in the walls of the half-shells. This will be explained hereinafter.

Figure 5:
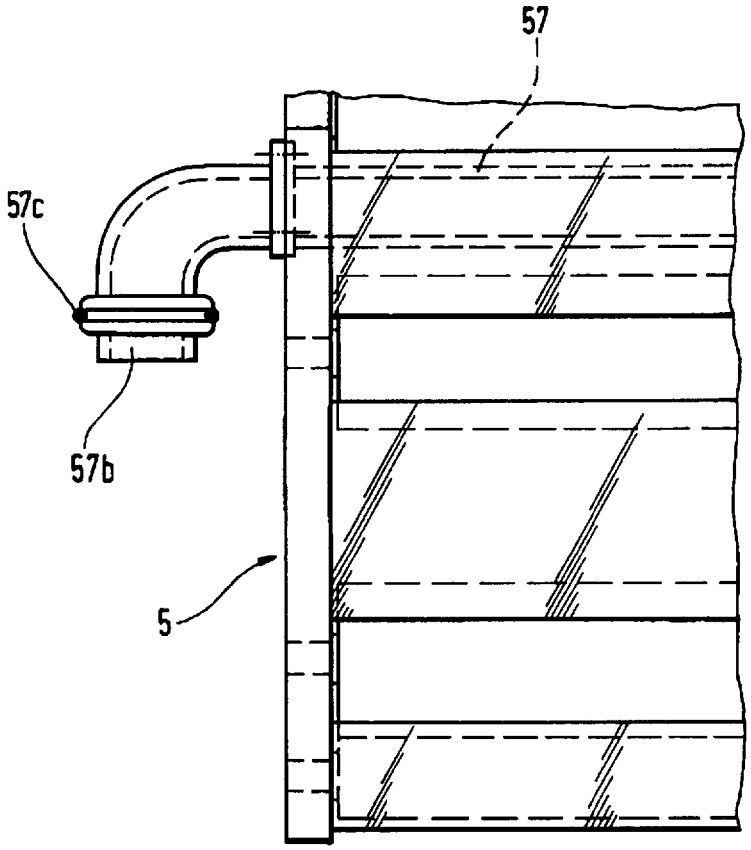
FIG. 5 is a detail of a second (i.e., central) element with a connection piece.

In conjunction with FIGS. 5, 6 and 7, it will now be explained how the tube 57 can slide together with the rack, that is, the central element 5, into the two half-shells. In the detail shown in FIG. 5, one can imagine oneself looking in FIG. 2 from the right toward the central element 5 and especially toward its left-hand end, which is not shown in FIG. 2 because it is located above the plane of the drawing. All that is of interest in FIG. 5 is the tube connector 57*b,* because upon the insertion of the central element 5 (rack) into the half-shells 1 and 2, this tube connector 57*b* slides into a corresponding bay 12 (FIG. 6) provided on the half-shells, where it comes to rest tightly, by means of an O-ring 57*c,* in a corresponding hollow-cylindrical counterpart in which an also hollow-cylindrical filter 13 is provided. With the insertion of the rack, the connection or supply of fresh or replenished developer fluid is thus assured simultaneously as well.

Figure 6:
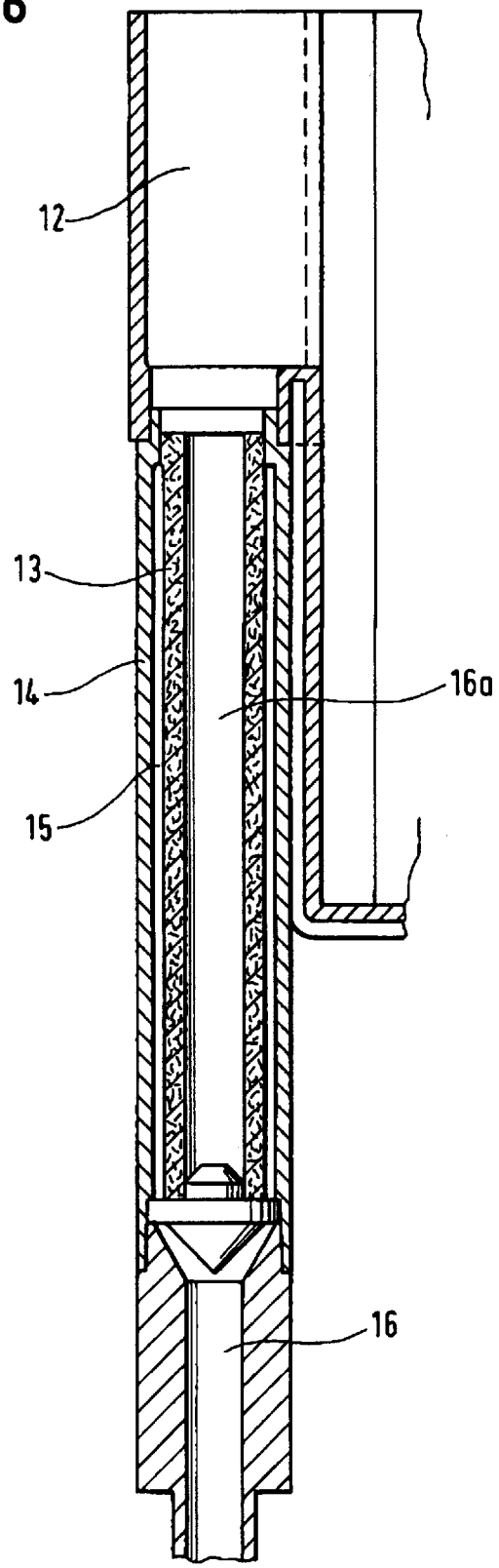
FIG. 6 is a detail of a half-shell with a bay.

FIG. 6 (highly enlarged) shows the bay 12, already mentioned, and the hollow-cylindrical counterpart 14 fixedly disposed in it, inside which the hollow-cylindrical filter 13 for trapping dirt (particles) is provided. The counterpart 14 is fixedly joined in fluid-tight fashion to the bay 12. A hollow-cylindrical chamber 15 is formed between the counterpart 14 and the filter 13. Fresh or replenished developer fluid can be fed into this hollow-cylindrical chamber 15 by means of a nozzle 16. The center axis 16*a* of all the cylindrical portions 13 to 16 is in, or is in parallel to the plane, located between the half-shells 1,2. Thus, the center axis 16*a* becomes an extension of the center axis of the tube 57 mentioned in FIG. 2, and thus the center axis of the tube 57 is arranged as an extension to the center axis 16*a* which is the center axis of all the cylindrical portions which are in connection with the reference numbers 13 to 16 of FIG. 6.

Figure 7:
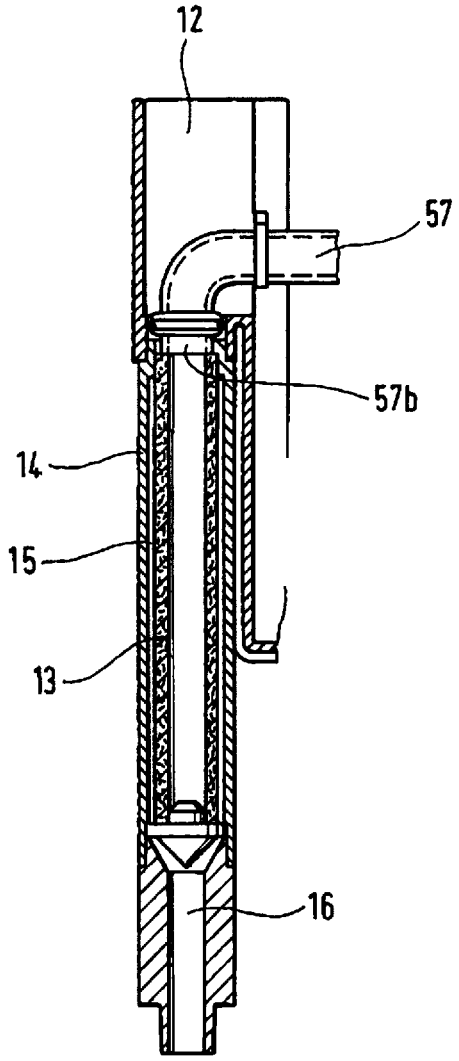
FIG. 7 is a detail of an exemplary apparatus in which the connection piece has already slid into the bay.

In FIG. 7, the tube connector 57*b* can be seen (on a smaller scale), introduced into the bay 12. The developer fluid passes from the hollow-cylindrical chamber 15 through the filter 13 into the tube connector 57*b* and thus into the tube 57.

Figure 8:
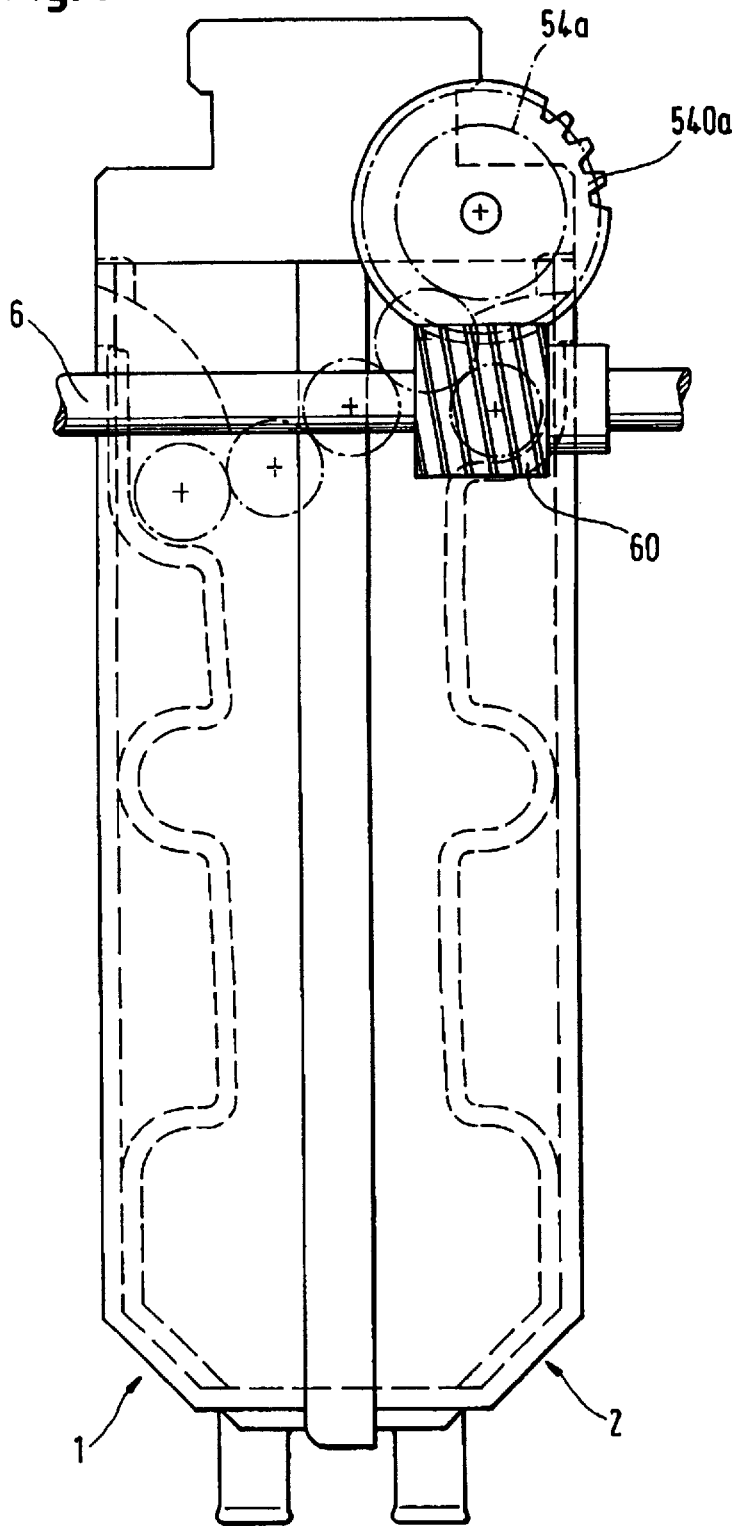
FIG. 8 is an exemplary embodiment of the drive means of an exemplary apparatus according to the invention.
Figure 9:
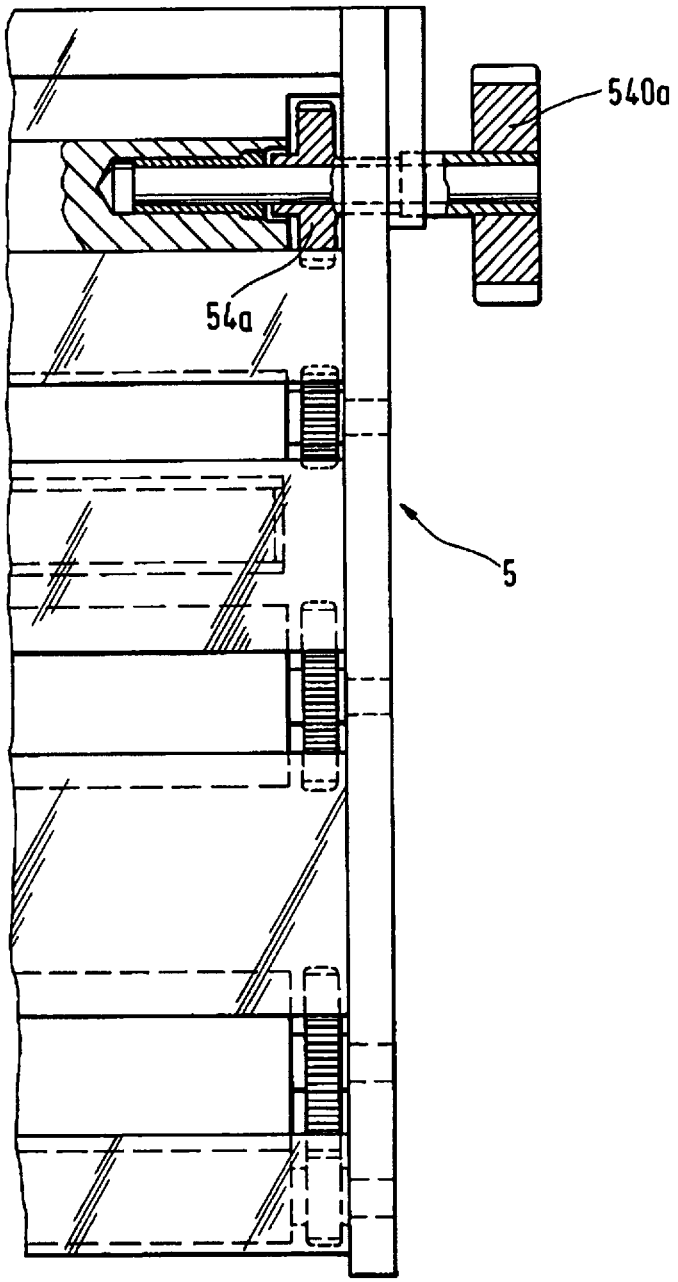
FIG. 9 is an enlarged detail of the drive means.

An exemplary embodiment of the drive means will now be briefly explained in conjunction with FIGS. 8 and 9. On a shaft 6, which extends outside the half-shells 1 and 2 (behind the plane of the drawing in terms of FIG. 8, so that the drive means would actually not be visible), a worm wheel 60 is provided, which meshes with a gear wheel 540*a*. The gear wheel 540*a* is likewise disposed outside the half-shells, but on the same shaft on which the gear wheel 54*a* is disposed. That is, this shaft protrudes into the interior formed by the two half shells 1 and 2. The gear wheel 54*a*, which now drives all the first and second transport rollers (by means of the shaft gear wheels and the intermediate gear wheels, as explained above) is in fact disposed in the interior of the apparatus. This kind of drive is advantageous in the sense that in practice, a plurality of such apparatuses, comprising half-shells and the elements to be introduced into them, can be connected in series, and all of them can be driven in synchronism by means of the shaft 6 and the worm wheels provided on it. This kind of overall drive means, disposed outside the interior of the apparatus, also has the advantage that whenever only one of the apparatuses has to be cleaned, it is unnecessary to remove or dismantle the entire drive means, as must be done if each apparatus has its own drive means that then is also disposed, where possible, inside the applicable apparatus.

In operation of this exemplary embodiment of the apparatus, the photographic material to be developed, such as individual sheets of paper or a strip of paper, passes through an inlet E (FIG. 4) with the aid of the guide pieces 31 and 51*a* (FIG. 2) between the rollers 30*a* and 50*b*, is guided between and through them, and then is transported along the conduit between the rollers 30*b* and 50*c* that is formed along the wall 10 (FIG. 1) and the guide pieces 51*a* and 51*b* (FIG. 4). On the passage of the paper through the rollers, the "used" developer fluid that still sticks to or interacts with the emulsion of the paper is virtually removed from the emulsion with the aid of the rollers, so that the emulsion of the paper can again enter into contact with "unused" developer fluid. Over the further transport path, the material passes between the rollers 30*c* and 50*d* (FIG. 2), is then guided with the aid of the guide pieces 32 and 51*d*, and especially with the aid of the surfaces 32*c* and 51*j*, between the rollers 50*d* and 50*e*, passes between the rollers 50*d* and 40*c* with the aid of the guide pieces 51*e* and 42, and is then transported upward again. Subsequently, it passes between the rollers 50*c* and 40*b*, then between the rollers 50*a* and 40*a*, and finally out of the apparatus through the outlet A (FIG. 4) or into a downstream apparatus, since in practice it is certainly possible for a plurality of such apparatuses to be connected in series.

It is clear that the spacing between two pairs of rollers succeeding one another in the paper transport path is maximally equivalent, in the case of single sheets, to the smallest size to be handled. It is also clear that to lengthen the path along which the paper is wet chemically treated, the half shells need merely be longer and have additional pouches, and that additional pairs of rollers can be provided and the dimensions of the ladderlike elements 3 and 4 and of the central element 5 (rack) can be adapted accordingly.

Figure 11:
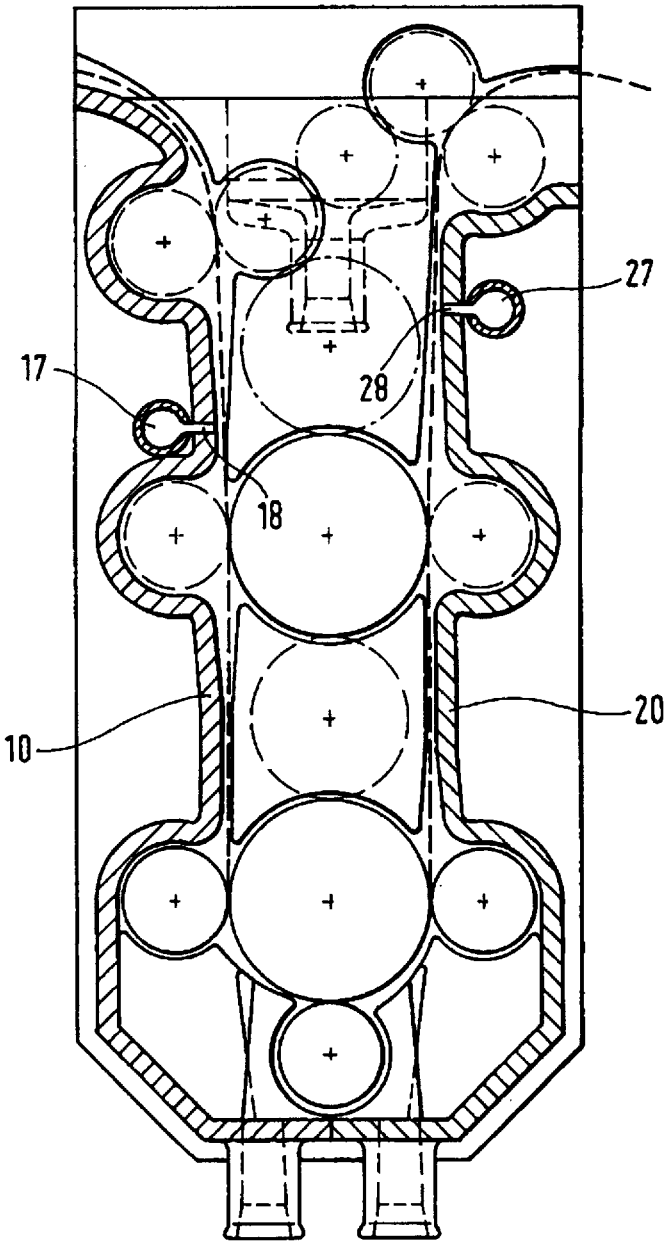
FIG. 11 is the exemplary embodiment of FIG. 10 in a sectional view.
Figure 12:
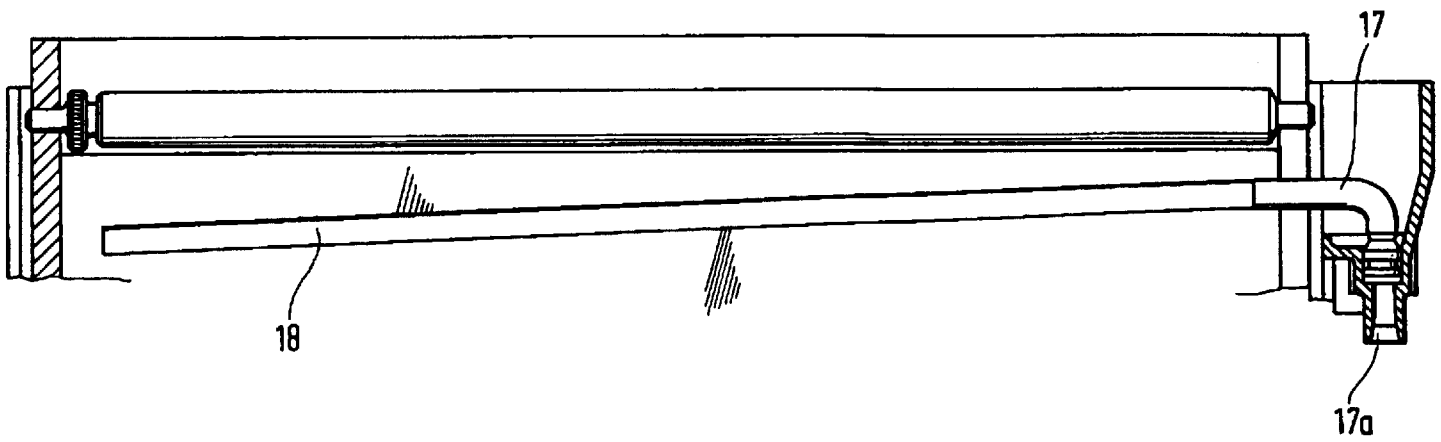
FIG. 12 is an illustration of slits for supplying developer fluid.

With the aid of FIGS. 10, 11 and 12, a further exemplary embodiment of an apparatus of the invention will now be explained, in which the supply of fresh or replenished developer fluid is provided not through a tube 57 in the central element 5 but rather through the wall 10 and/or 20 of the two half-shells 1 and 2. This is advantageous especially if the emulsion side of the paper to be developed points toward the wall 10 or 20 ("coating side out") as it is transported through the conduit.

Figure 10:
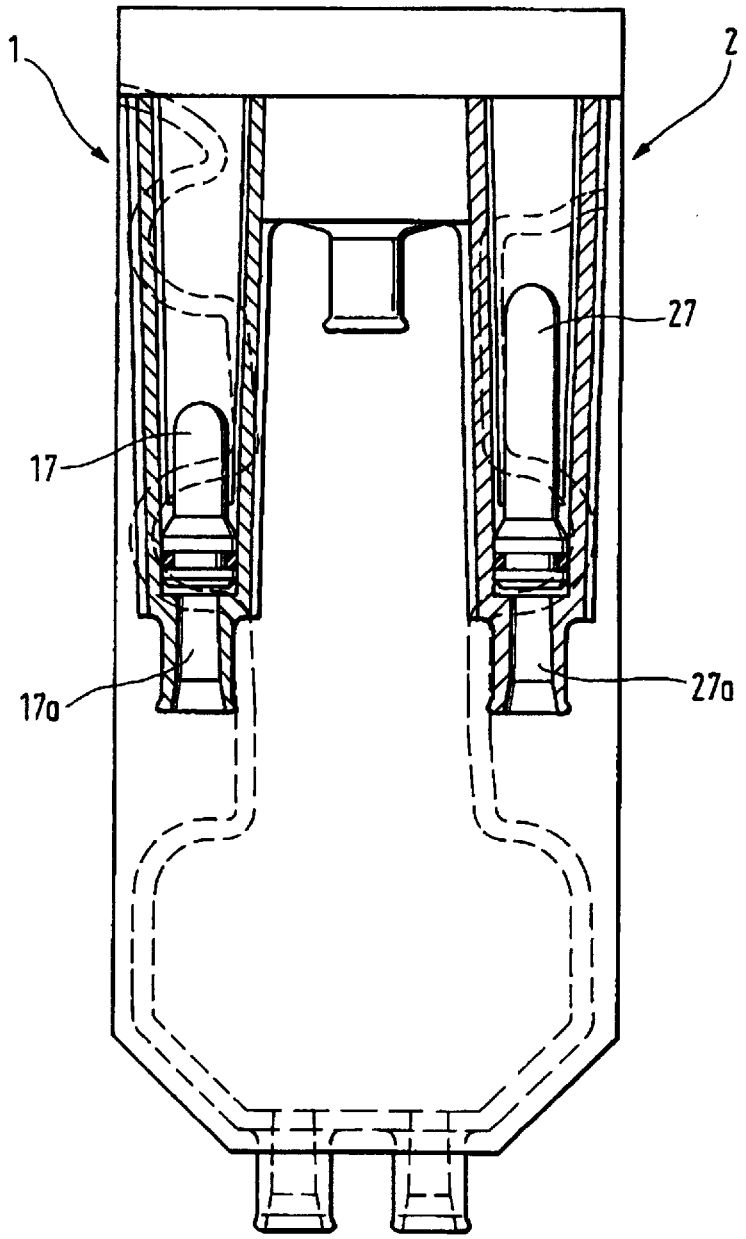
FIG. 10 is an exemplary embodiment of an apparatus of the invention, in which the connection pieces for supplying developer fluid to the half-shells are provided.

In FIG. 10, a view can be seen in which the connection pieces 17*a* and 27*a* for supplying developer fluid are visible. The respective connection pieces 17*a* and 27*a* discharge into respective tubes 17 and 27 (FIG. 11), which extend along the respective walls 10 and 20. Through slits 18 and 28 (FIG. 12) in the walls 10 and 20, the fresh or replenished developer fluid acts upon the paper to be developed. The slit 18 is inclined over the width of the conduit or, in other words, is in a plane parallel to the plane of the photographic material guided in the conduit. This can be seen in FIG. 12. In this way, the front edge of the photographic material cannot slip into the slit, and backups are thus avoided. In its basic mode of operation, this exemplary embodiment differs from that explained above essentially only in that the developer fluid is in fact fed through a slit 18 and/or 28 in the walls 10 and/or 20. rather than through the slit-like openings 56*a* and 56*b* of the central element 5 (rack). It is understood that as needed, still other such slits can be provided at various other points in the wall 10 or 20, as is described, for instance, in U.S. Pat. No. 5,270,762 (see, for example, FIGS. 9 and 10 thereof), the disclosure of which is hereby incorporated by reference in its entirety.

If a corresponding circulatory loop with pumps is provided, as contemplated and explained, for instance, in U.S. Pat. No. 5,309,191, the disclosure of which is hereby incorporated by reference in its entirety, then fresh or replenished developer fluid can continuously be supplied, and used developer fluid continuously removed. Moreover, in this way the developer fluid can be continuously moved and mixed. Because of the constant supplying of fresh or replenished developer fluid, the photographic material (paper) to be developed can be acted upon virtually constantly with fresh or replenished developer fluid, and good quality of the developed pictures is assured.

Fundamentally, the development apparatuses described are suitable especially for developing exposed photographic paper, especially for paper in sheet form but also paper strips. A plurality of such apparatuses can also be connected in series. The apparatus can be manufactured simply (by plastics technology), can be easily and above all quickly assembled and taken apart, in the event that individual parts—especially the rollers—must be cleaned, and is reliable in its function. The volume of developer fluid present in the apparatus can be maintained low. Since the exposed surface area of the fluid is also slight, only slight oxidation occurs. Because of the small total volume of developer fluid, only this small volume of developer fluid has to be drained out and disposed of in maintenance or cleaning. This is advantageous from the standpoint of both environmental protection and cost. In the ensuing filling of the apparatus after maintenance or cleaning, once again only a small quantity of developer fluid is necessary. Moreover, because of the small required volume, the developer fluid can also be heated faster to its operating temperature (typically about 35° C. to 38° C.). As a consequence, the minilabs or microlabs need not be turned on constantly, and moreover electrical power consumed is reduced.

The developing apparatuses and associated methods of operation described herein are suitable especially for use in minilabs and microlabs for single-sheet processing, because in the field of minilabs and microlabs, large numbers of standard jobs are less crucial; what is more important instead is the ability to satisfy special customer demands flexibly and quickly. For example, such apparatuses should accommodate changing the paper size quickly, and upon such a change of paper size, maintain paper losses slight. On the professional level (large formats), single-sheet processing again plays an important role.

Although the apparatus and associated method described is especially suitable for processing paper, it is entirely possible to use such developing apparatuses for developing films or other sheet-like materials.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An apparatus for developing photographic material, comprising:

a delivery device for supplying developing fluid;

an inlet for receiving material to be developed;

an outlet for dispensing developed material;

a conduit that extends from the inlet to the outlet;

transport means that transport the photographic material to be developed from the inlet through the conduit to the outlet, wherein the material to be developed, during transport through the conduit, comes in contact with the developer fluid;

two half shells configured to be joined together, in whose walls pouches are provided;

two elements formed as two approximate ladderlike elements, on each of which first transport rollers are provided, the first transport rollers being disposed on the ladderlike elements such that upon insertion of the ladderlike elements into the joined-together half-shells, the transport rollers fit into the pouches of the walls of the two half-shells; and a central element configured for placement between the two ladderlike elements to maintain the two ladderlike elements in position within the joined together half-shells, said central element together with the ladderlike elements and the walls of the half-shells, defining the conduit which extends between each of the ladderlike elements and the central element and between the walls of each of the half-shells and the central element, said central element including second transport rollers which, upon insertion of the central element into the joined together half-shells, contact the first transport rollers of the ladderlike elements so that the photographic material to be developed is guided between the first transport rollers and the second transport rollers and transported through the conduit.

2. The apparatus of claim 1, further comprising:

a drive means in operable communication with the central element and a force transmitting means, such that the force transmitting means drives the second transport rollers.

3. The apparatus of claim 2, wherein the force transmitting means also drives the first transport rollers of the two ladderlike elements, such that a single drive means drives all of the first and second transport rollers.

4. The apparatus of claim 2, wherein the drive means further includes:

a worm wheel supported on a drivable shaft;

a single shaft expansion and a gear wheel secured to the single shaft extension for each of the second transport rollers; and a further wheel disposed between each of the gear wheels that are secured to the single shaft extensions, the gear wheels that are secured to the single shaft extension and the gear wheels disposed between them operably meshing with one another such that a gear wheel supported on the drivable shaft meshes with a gear wheel on an adjacent single shaft extension, that meshes with the gear wheel on a next adjacent single shaft extension.

5. The apparatus of claim 3, wherein the drive means further includes:

a worm wheel supported on a drivable shaft;

a single shaft expansion and a gear wheel secured to the single shaft extension for each of the second transport rollers; and a further wheel disposed between each of the gear wheels that are secured to the single shaft extensions, the gear wheels that are secured to the single shaft extension and the gear wheels disposed between them operably meshing with one another such that a gear wheel supported on the drivable shaft meshes with a gear wheel on an adjacent single shaft extension, that meshes with the gear wheel on a next adjacent single shaft extension.

6. The apparatus of claim 4, wherein each of the first transport rollers provided on the ladderlike elements has its own shaft extension on which a gear wheel is secured, the gear wheel on the shaft extension of each first transport roller meshing with a gear wheel on the single shaft extension of an associated second transport roller.

7. The apparatus of claim 5, wherein each of the first transport rollers provided on the ladderlike elements has its own shaft extension on which a gear wheel is secured, the gear wheel on the shaft extension of each first transport roller meshing with a gear wheel on the single shaft extension of an associated second transport roller.

8. The apparatus of claim 1, further comprising:

a feeder for supplying at least one of a fresh and a replenished developing fluid, said feeder being provided on the central element; and openings provided on the central element, which are disposed pointing toward the conduit, so that the at least one of a fresh and a replenished developer fluid passes through the openings into the conduit and acts upon the photographic material to be developed.

9. The apparatus of claim 7, further comprising:

a feeder for at least one of a fresh and a replenished developing fluid, said feeder being provided on the central element; and openings provided on the central element, which are disposed pointing toward the conduit, so that the at least one of a fresh and a replenished developer fluid passes through the openings into the conduit and acts upon the photographic material to be developed.

10. The apparatus of claim 8, further comprising:

a filter for the developer fluid delivered through the feeder, said filter being disposed in the central element.

11. The apparatus of claim 8, wherein the feeder provided on the central element for the at least one of a fresh and a replenished developer fluid further includes:

a connection piece disposed stationarily relative to the central element, which upon insertion of the central element into the joined-together half-shells automatically passes into a bay of the half-shells, said bay being provided with a counterpart that communicates with the feeder for at least one of a fresh and a replenished developer fluid.

12. The apparatus of claim 11, further comprising:

a filter for the developer fluid, said filter being disposed in the counterpart.

13. The apparatus of claim 1, further comprising:

connections for at least one of a fresh and a replenished developer fluid provided on the two half-shells, the walls of the two half-shells including openings through which the at least one of a fresh and a replenished developer fluid reaches the conduit and acts upon the photographic material to be developed.

14. The apparatus of claim 7, further comprising:

connections for at least one of a fresh and a replenished developer fluid provided on the two half-shells, the walls of the two half-shells including openings through which the at least one of a fresh and a replenished developer fluid reaches the conduit and acts upon the photographic material to be developed.

15. The apparatus of claim 8, wherein the openings are embodied as slits which extend approximately along a width of the conduit and along a width of a photographic material to be developed.

16. The apparatus of claim 14, wherein the openings are embodied as slits which extend approximately along a width of the conduit and along a width of the photographic material to be developed, such that the slits are inclined in a plane approximately parallel to the plane of the photographic material located in the conduit.

17. The apparatus of claim 1, wherein the half-shells are formed of plastic.

18. Method for preparing an apparatus for developing photographic material, comprising the steps of:

joining two half-shells together, in whose walls pouches are provided;

inserting two elements, approximately formed as two ladderlike elements, into the joined-together half-shells, on each of the elements first transport rollers are provided, the first transport rollers being disposed on the respective ladderlike elements such that upon insertion of the ladderlike elements into the joined-together half-shells, the transport rollers fit into the pouches of the walls of the respective half-shell; and placing a central element, upon insertion of the two ladderlike elements into the joined together half-shells, between the two ladderlike elements to maintain the two ladderlike elements in position and the central element, together with ladderlike elements and the walls of the half-shells, defining a conduit for the photographic material to be developed, which conduit extends between each of the ladderlike elements and the central element, and between the walls of each of the half-shells and the central element, said central element including second transport rollers which, upon insertion of the central element into the joined together half-shells, contact the first transport rollers of the ladderlike elements so that the photographic material to be developed is guided between the first transport rollers and the second transport rollers and transported through the conduit, wherein the conduit contains developing fluid for the photographic material to contact when the photographic material is transported through the conduit.

19. Method according to claim 18 wherein the half-shells are formed using plastics technology.

20. Method according to claim 18 wherein the half-shells are formed using injection molding technology.

* * * * *